US007703171B2

(12) United States Patent
Lee et al.

(10) Patent No.: US 7,703,171 B2
(45) **Date of Patent: *Apr. 27, 2010**

(54) COMPLEX TYPE CLEANER

(75) Inventors: Yong Woo Lee, Seoul (KR); Choon Myun Chung, Gyeonggi-Do (KR); Ho Seon Rew, Seoul (KR); Hyeun Sik Nam, Seoul (KR); Young Gyu Jung, Incheon (KR)

(73) Assignee: LG Electronics Inc., Seoul (KR)

( * ) Notice: Subject to any disclaimer, the term of this patent is extended or adjusted under 35 U.S.C. 154(b) by 1454 days.

This patent is subject to a terminal disclaimer.

(21) Appl. No.: 11/028,236

(22) Filed: Jan. 4, 2005

(65) Prior Publication Data

US 2006/0085941 A1 Apr. 27, 2006

(30) Foreign Application Priority Data

Oct. 27, 2004 (KR) ..... 10-2004-0086369

(51) Int. Cl.
*A47L 11/30* (2006.01)
*A47L 7/00* (2006.01)

(52) U.S. Cl. ..... 15/320; 15/353

(58) Field of Classification Search ..... 15/320–322, 15/328, 331, 353, 302, 327.1
See application file for complete search history.

(56) References Cited

U.S. PATENT DOCUMENTS 3,869,749 A * 3/1975 London et al. ..... 15/302
4,096,601 A * 6/1978 Knestele ..... 15/320
4,349,935 A * 9/1982 Knestele ..... 15/320
4,887,330 A 12/1989 Woodhall et al.
5,093,955 A * 3/1992 Blehert et al. ..... 15/320
5,301,386 A * 4/1994 Thomas et al. ..... 15/321
5,640,738 A * 6/1997 Williams et al. ..... 15/320
5,867,861 A 2/1999 Kasen et al.
6,073,300 A 6/2000 Zahuranec et al.
6,131,237 A * 10/2000 Kasper et al. ..... 15/320
6,832,409 B2 * 12/2004 Morgan et al. ..... 15/354
7,000,286 B2 * 2/2006 Wang ..... 15/320
7,254,864 B2 * 8/2007 Cipolla et al. ..... 15/320

(Continued)

FOREIGN PATENT DOCUMENTS

GB 2419516 5/2006

OTHER PUBLICATIONS

U.S. Appl. No. 11/029,383 to Yong Woo Lee et al.

(Continued)

*Primary Examiner*—David B Thomas
(74) *Attorney, Agent, or Firm*—KED & Associates, LLP

(57) ABSTRACT

A cleaner includes a body provided with a dust collecting container for storing dust, a fan motor installed at the body and generating a suction force; a vacuum cleaning head disposed at a lower side of the body, into which dust is sucked when the cleaner performs vacuum cleaning. A water cleaning head is mounted at the vacuum cleaning head, for spraying cleaning water onto a region to be cleaned, sucking contaminated water after completing water cleaning, and storing the sucked contaminated water, when water cleaning. By implementing both a vacuum cleaning function for sucking dust and a water cleaning function in one cleaner, a cleaner capable of reducing the cost and, increasing convenience of use is provided.

20 Claims, 7 Drawing Sheets

U.S. PATENT DOCUMENTS

| | | | | |
|---|---|---|---|---|
| 7,322,071 | B2 * | 1/2008 | Lee et al. | 15/320 |
| 7,377,009 | B2 | 5/2008 | Lee et al. | |
| 2006/0085942 | A1 | 4/2006 | Lee et al. | |
| 2006/0090285 | A1 | 5/2006 | Lee et al. | |
| 2006/0090288 | A1 | 5/2006 | Lee et al. | |

OTHER PUBLICATIONS

U.S. Appl. No. 11/029,382 to Yong Woo Lee et al.
U.S. Appl. No. 11/029,365 to Yong Woo Lee et al.

* cited by examiner

COMPLEX TYPE CLEANER

BACKGROUND OF THE INVENTION

1. Field of the Invention

The present invention relates to a complex type cleaner, and more particularly, to a complex type cleaner capable of selectively performing vacuum cleaning for sucking dust and foreign materials and water cleaning for cleaning a region to be cleaned by spraying cleaning water in one cleaner.

2. Description of the Background Art

Generally, an upright type vacuum cleaner includes: a body arranged in an upright state; a suction fan mounted in the body and generating a suction force; a filter container having a filter therein for collecting dust or filth sucked by the suction force generated from the suction fan; a suction head disposed at a lower side of the body, for sucking dust or filth on a floor; and a brush rotatably installed at the suction head, for sweeping up dust and filth on the floor.

In the upright type vacuum cleaner, when the suction fan is driven, a suction force is generated. Dust and foreign materials on a floor or a carpet are sucked through the suction head by the generated suction force. Then, the dust and foreign materials are filtered by the filter and collected in the filter container.

In addition, a general extractor includes: a water supply container containing cleaning liquid; a pump for pumping the cleaning liquid contained in the water supply container; a spray nozzle for spraying the cleaning liquid pumped by the pump onto a region to be cleaned; a suction nozzle for sucking contaminated water and dust on the region to be cleaned onto which the cleaning liquid is sprayed by the spray nozzle; a water collecting container for storing the contaminated water sucked through the suction nozzle; and a suction fan for generating a suction force so that the contaminated water can be sucked into the suction nozzle.

In the extractor, the pump is driven, the cleaning liquid stored in the water supply container is sprayed onto the carpet or the like through the spray nozzle, and the brush rotates to rub the carpet. Then, contaminated water is sucked through the suction nozzle and collected in the water collecting container. At this time, air is exhausted to the outside.

In the conventional cleaner, since a vacuum cleaner should be provided for vacuum cleaning of dust and filth, and an extractor should be provided for water cleaning of the carpet or the like, two cleaners are required, thereby increasing the cost. In addition, since much room is occupied in storing two cleaners, inconvenience is resulted from keeping the two cleaners.

SUMMARY OF THE INVENTION

Therefore, an object of the present invention is to provide a complex type cleaner capable of reducing the cost, improving convenience for use and facilitating the keeping by implementing both a vacuum cleaning function for sucking dust and a water cleaning function by spraying cleaning water onto a region to be cleaned in one cleaner.

Another object of the present invention is to provide a complex type cleaner capable of reducing the number of parts and a production cost, and employing a small capacity fan motor as a suction nozzle for sucking water contaminated after completing a cleaning job, a storage container for storing the contaminated water sucked through the suction nozzle, and a cleaning water spray unit for spraying cleaning water onto a region to be cleaned are integrally formed and installed at a suction head.

Still Another object of the present invention is to provide a complex type cleaner capable of minimizing contaminated water's backflowing into the floor after completing a cleaning job by minimizing a flow passage through which the contaminated water passes by integrally forming the suction nozzle for sucking the contaminated water and the storage container for storing the contaminated water.

To achieve these and other advantages and in accordance with the purpose of the present invention, as embodied and broadly described herein, there is provided a complex type cleaner of the present invention, comprising: a body provided with a dust collecting container for storing dust; a fan motor installed at the body and generating suction force; a vacuum cleaning head disposed at a lower side of the body, into which dust is sucked in case the cleaner performs vacuum cleaning; and a water cleaning head mounted at the vacuum cleaning head, for spraying cleaning water onto a region to be cleaned, sucking contaminated water after completing water cleaning, and storing the sucked contaminated water, at the time of water cleaning.

A brush is installed within the dust cleaning head, and the brush sweeps up dust on the region to be cleaned at the time of a vacuum cleaning mode and rubs the region to be cleaned onto which cleaning water is sprayed at the time of a water cleaning mode.

The water cleaning head comprises: a storage container mounted at an upper surface of the dust cleaning head and, divided into a first chamber for storing cleaning water for water cleaning and a second chamber for storing water contaminated after completing water cleaning; and a suction nozzle installed at an upper surface of the storage container, for sucking water contaminated after completing water cleaning.

The first chamber comprises a cleaning water supply unit including: a cleaning water supply hose connected to the first chamber and supplying the cleaning water stored in the first chamber to the region to be cleaned; a pump installed at the cleaning water supply hose and pumping the cleaning water stored in the first chamber; and a spray nozzle installed at the end of the cleaning water supply hose and spraying the cleaning water pumped by the pump onto the region to be cleaned.

The second chamber includes an inlet communicating with the suction nozzle, into which contaminated water flows, and a discharge opening for discharging air inside the second chamber when the contaminated water is sucked through the inlet.

A floater which closes up the discharge opening by being raised by a buoyancy force so as to prevent water flowing into the second chamber from being discharged through the discharge opening is installed on the second chamber.

The suction nozzle comprises: a nozzle portion disposed at a front of the dust suction opening, through which water is sucked; and a guide passage portion integrally formed with the nozzle portion and guiding contaminated water sucked through the nozzle portion to the inlet of the second chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, one embodiment of a complex type cleaner in accordance with the present invention will be described with reference to the accompanying drawings.

There can be a plurality of embodiments in accordance with the present invention, and, hereinafter, the most preferable embodiment will be described.

Figure 1:
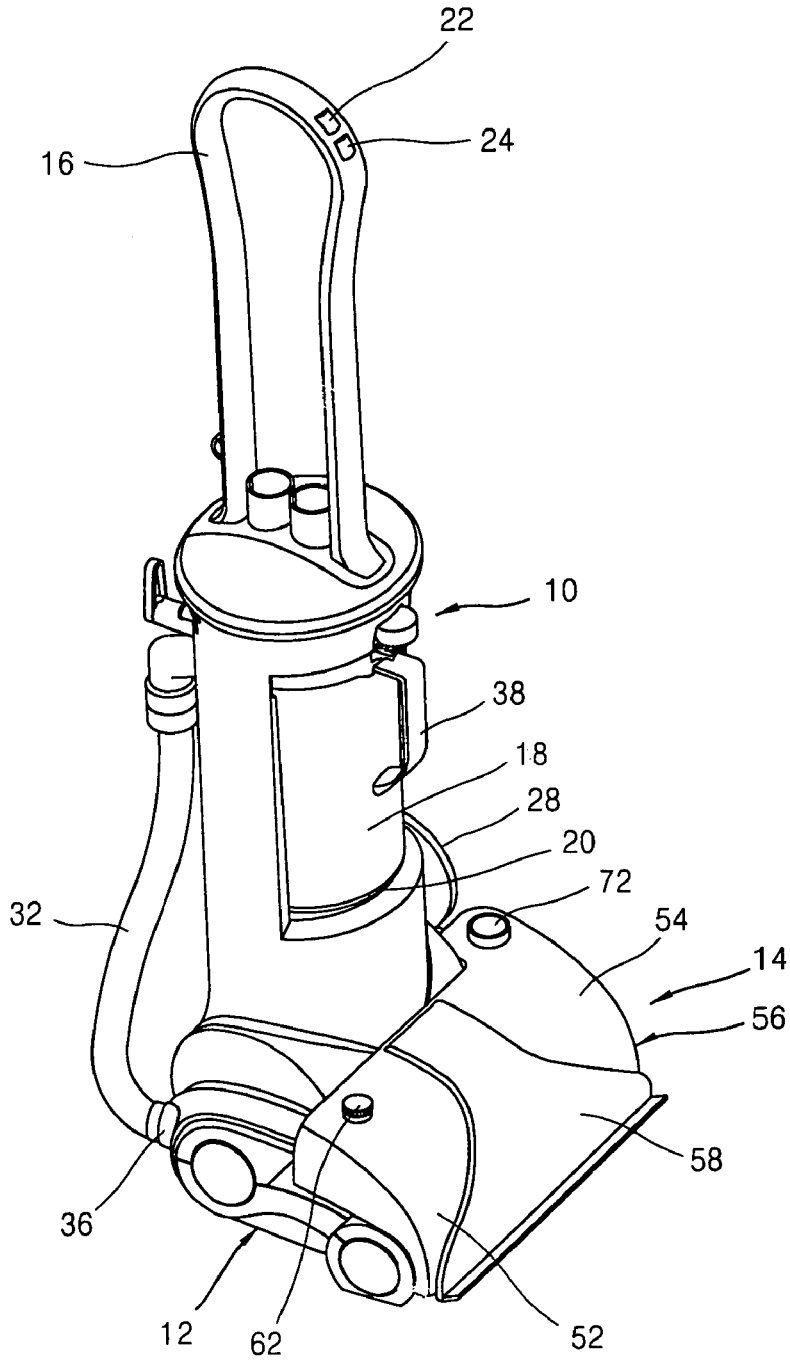
FIG. 1 is a perspective view showing a complex type cleaner in accordance with one embodiment of the present invention.
Figure 2:
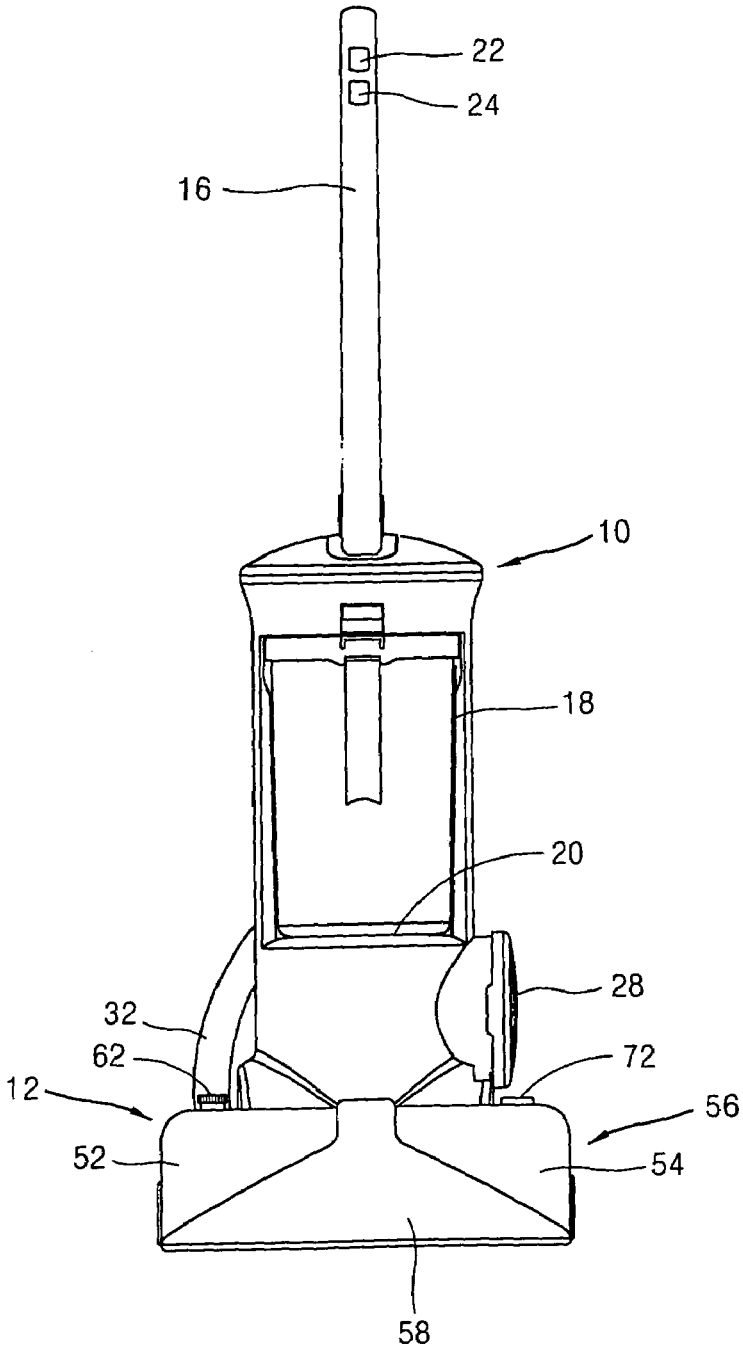
FIG. 2 is a side view showing the complex type cleaner in accordance with one embodiment of the present invention.
Figure 3:
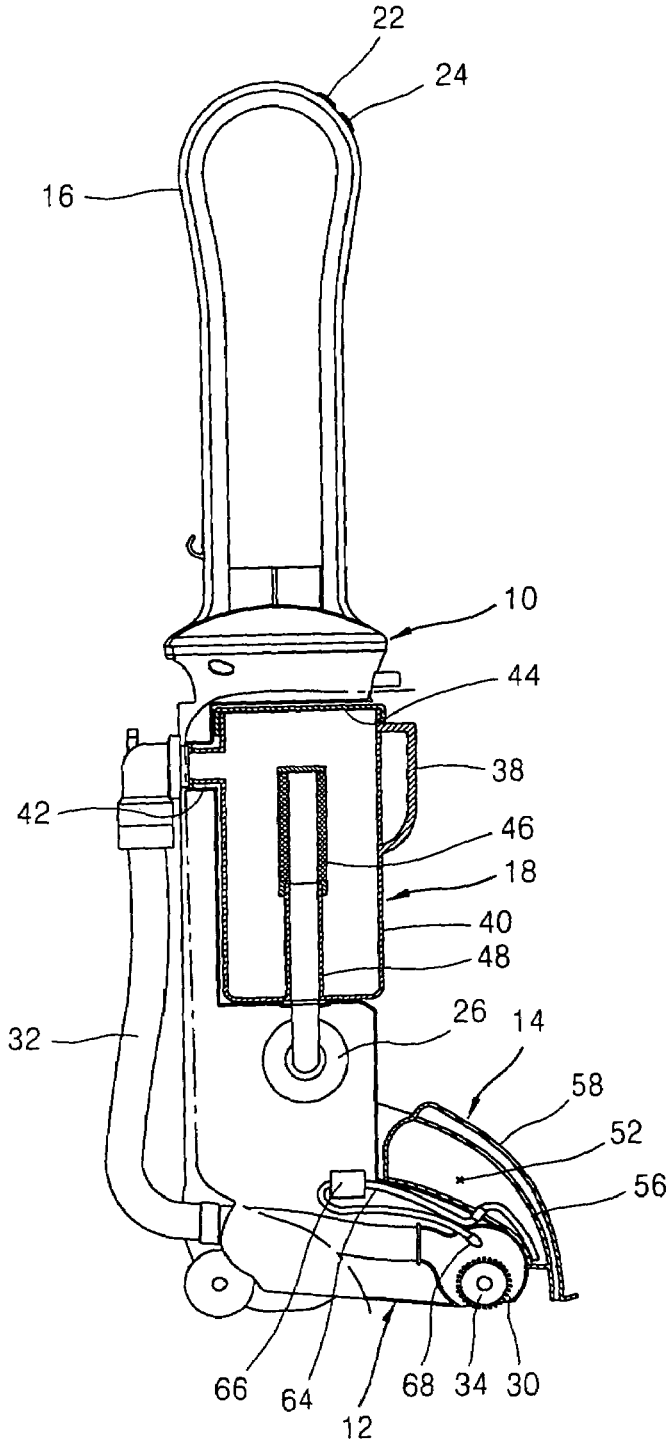
FIG. 3 is a cross-sectional view showing the complex type cleaner in accordance with one embodiment of the present invention.

FIG. 1 is a perspective view showing a complex type cleaner in accordance with one embodiment of the present invention, FIG. 2 is a side view showing the complex type cleaner in accordance with one embodiment of the present invention, and FIG. 3 is a cross-sectional view showing the complex type cleaner in accordance with one embodiment of the present invention.

The cleaner in accordance with one embodiment of the present invention includes: a body 10 arranged in an upright state; a vacuum cleaning head 12 disposed at a lower side of the body 10, for sucking dust at the time of performing vacuum cleaning; and a water cleaning head 14 installed at the vacuum cleaning head 12, the water cleaning head 14 into which water contaminated after completing a cleaning job is sucked and in which the sucked contaminated water is stored, at the time of water cleaning.

The body 10 is provided with a handgrip 16 at an upper side thereof, and a container mounting portion 20 for mounting a dust collecting container 18 for collecting dust is formed at a front side of the body 10.

A vacuum cleaning switch 22 adjusted by a user in case of the vacuum cleaning mode for sucking dust and a water cleaning switch 24 adjusted by a user in case of the water cleaning mode are installed on the handgrip 16.

In addition, a fan motor 26 connected to the dust collecting container 18, for generating suction force is mounted at a lower side of the container mounting portion 20, and an outlet 28 for exhausting clean air filtered while passing through the dust collecting container 18 to the outside is formed at one side of the fan motor 26.

The vacuum cleaning head 12 is rotatably mounted at a lower portion of the body 10, a dust suction opening 30 into which dust and foreign substances are sucked is formed at a lower surface of the vacuum cleaning head 12, and a hose connection portion 36, which is connected to a suction hose 32 for guiding the dust having been sucked through the dust suction opening 30 to the dust collecting container 18, is formed at the rear of the vacuum cleaning head 12.

In addition, a brush 34 is rotatably mounted at a lower portion of the vacuum cleaning head 12, and the brush sweeps up dust and foreign substances on a floor and a carpet toward the inside of the air suction opening 30 at the time of a vacuum cleaning mode, and rubs a region to be cleaned onto which cleaning liquid is sprayed at the time of a water cleaning mode.

The dust collecting container 18 includes: a container 40 mounted at the container mounting portion 20 formed at the body 10, having a space for collecting dust, and having a handgrip 38 at one side thereof; a cover 44 openably mounted at an upper surface of the container 40; an inlet 42 formed at one side of the container 40 and connected to the suction hose 32 for sucking dust and foreign materials into the container 40; a filter 46 arranged in the container 40, for filtering dust and foreign materials having been sucked into the container 40; and an exhaust passage 48 formed at a lower side of the container 40, connected to the filter 46 for exhausting air purified while passing through the filter 46, and connected to the fan motor 26.

Figure 4:
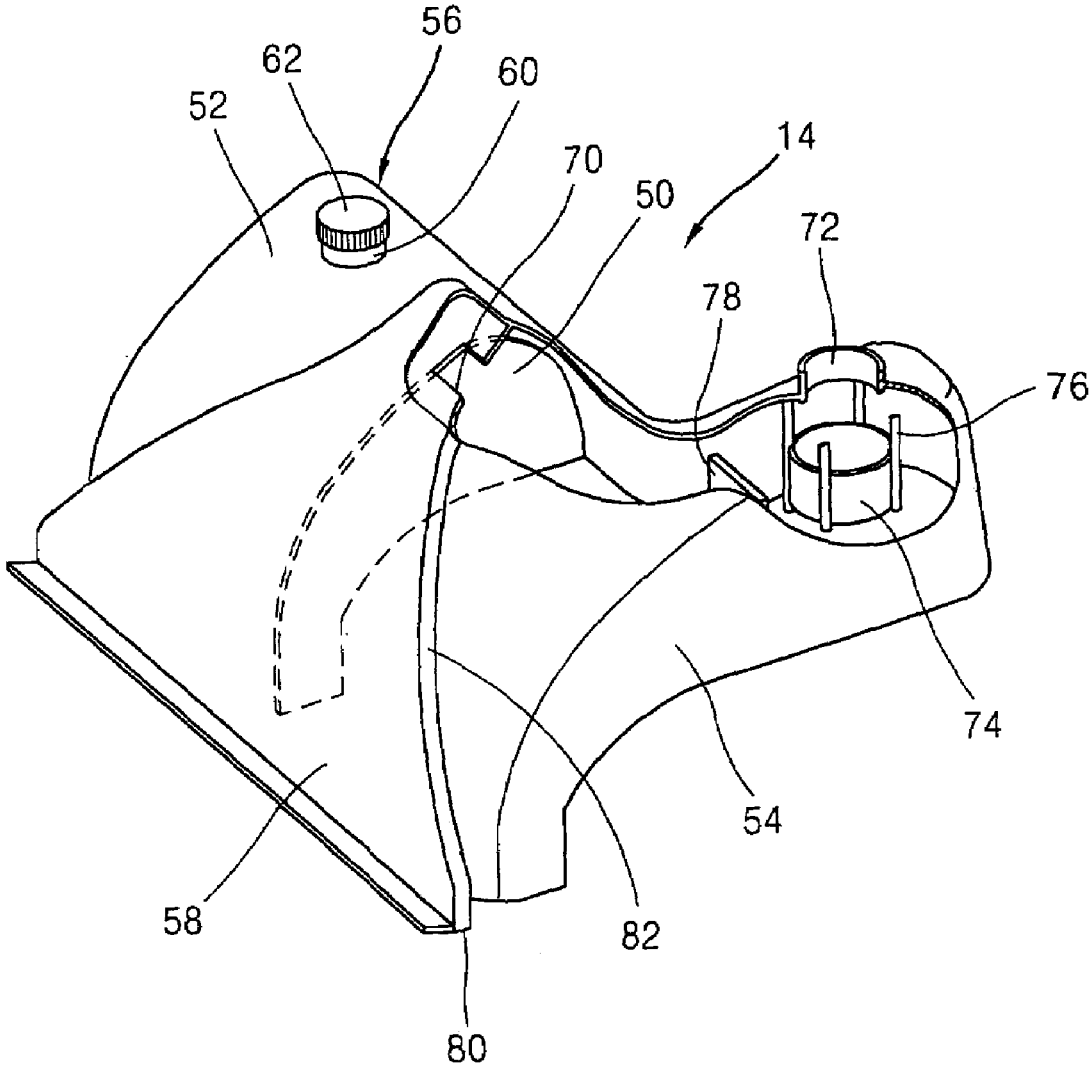
FIG. 4 is a perspective view showing a storage container in accordance with the present invention.
Figure 5:
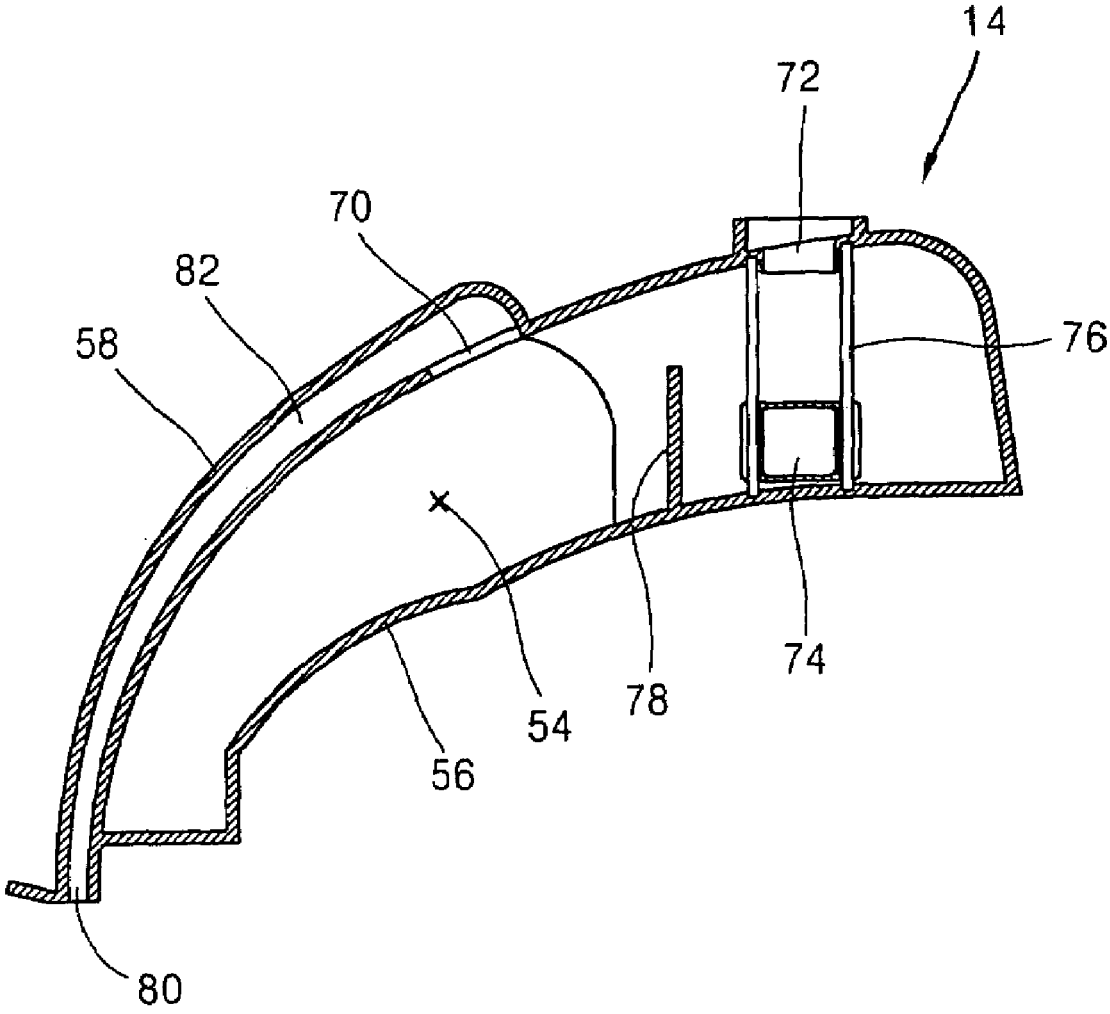
FIG. 5 is a cross-sectional view showing the storage container in accordance with the present invention.

FIG. 4 is a perspective view showing the water cleaning head in accordance with the present invention, and FIG. 5 is a cross-sectional view showing the water cleaning head in accordance with the present invention.

The water cleaning head 14 includes: a storage container 56 mounted at an upper surface of the vacuum cleaning head 12 and divided into two chambers by a partition 50 to thereby form a first chamber 52 for storing cleaning water for water cleaning and a second chamber 54 for storing water contaminated after completing water cleaning; and a suction nozzle 58 installed at an upper surface of the storage container 56, through which the water contaminated after completing water cleaning is sucked.

Herein, a supply opening 60 through which cleaning water is supplied into the first chamber 52 is formed on the first chamber 52, and a cap 62 for opening or closing the supply opening 60 is mounted at the supply opening 60. In addition, the first chamber 52 is connected to a cleaning water supply unit for spraying cleaning water stored in the first chamber 52 onto the region to be cleaned.

The cleaning water supply unit includes: a cleaning water supply hose 64 connected to the first chamber 52 and supplying cleaning water stored in the first chamber 52 to a region to be cleaned; a pump 66 installed at the cleaning water supply hose 64 and pumping the cleaning water stored in the first chamber 52; and a spray nozzle 68 installed at the end of the cleaning water supply hose 64 and spraying the cleaning water pumped by the pump 66 onto the region to be cleaned.

An inlet 70 communicating with the suction nozzle 58, into which contaminated water flows, and an air discharge opening 72 for discharging air inside the second chamber 54 through the suction hose 32 when the contaminated water is sucked through the inlet 70 are formed at an upper surface of the second chamber 54.

A floater 74 for preventing water flowing into the second chamber 54 from being discharged through the air discharge opening 72 is installed inside the second chamber 54.

The floater 74 is vertically movably disposed to a floater housing 76 formed inside the second chamber 54 and floats up by a buoyancy force when water is filled to thereby close up the air discharge opening 72.

In addition, a blocking plate 78 for preventing water introduced through the inlet 70 from being spattered towards the air discharge opening 72 and contaminated water stored in the second chamber 54 from flowing through the air discharge opening 72 until the contaminated water reaches a certain level is formed between the inlet 70 in the second chamber 54 and the air discharge opening 72.

The suction nozzle 58 includes: a nozzle portion 80 provided with an entrance having a narrow width in order to easily suck water on the floor; and a guide passage portion 82 integrally formed with the nozzle portion 80 and communicating with the inlet 70 of the second chamber 54 such that contaminated water having been sucked into the nozzle portion 80 can be guided to the inlet 70 of the second chamber 54.

An operation of the complex type cleaner in accordance with the present invention will be described as follows.

Figure 6:
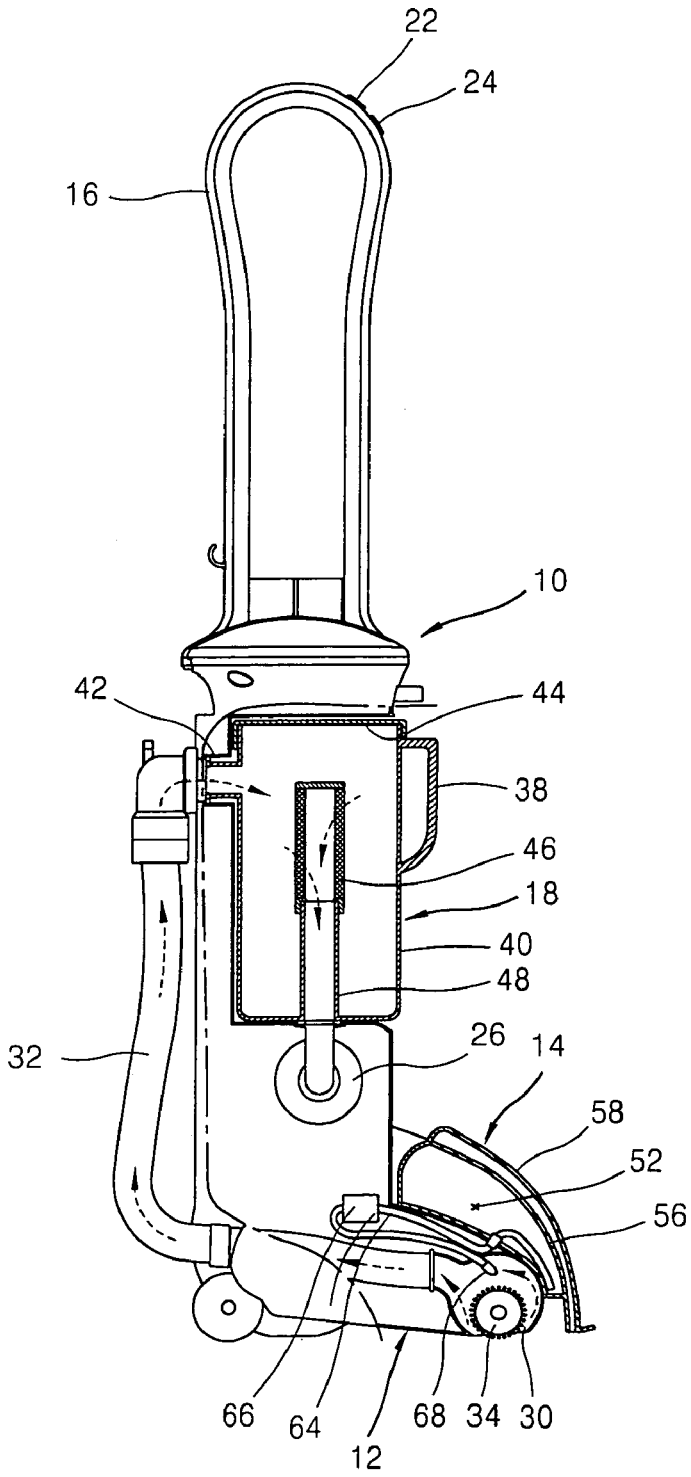
FIGS. 6 and 7 are views showing an operation of the complex type cleaner in accordance with one embodiment of the present invention.

FIG. 6 is a view showing an operation when the complex type cleaner in accordance with the present invention is used in a vacuum cleaning mode.

Firstly, when the cleaner is used in the vacuum cleaning mode, the user mounts the dust collecting container 18 at the container mounting portion 20 of the body 10, connects the suction hose 32 to the hose connection portion 36 of the vacuum cleaning head 12, and then operates the vacuum cleaning switch 22.

Then, the fan motor 26 is driven to generate a suction force, and therefore dust and foreign substances on the floor or the carpet are sucked into the vacuum cleaning head 12 through the dust suction opening 30. At this time, the brush 34 mounted at the suction opening 30 is rotated to sweep up the dust and the foreign substances on the floor or the carpet towards the inside of the vacuum cleaning head 12. The dust and the foreign substances on the floor or the carpet flow into the container 40 of the dust collecting container 18 through the suction hose 32, the dust and the foreign substances on the floor or the carpet sucked into the container 40 are filtered by the filter 46 and collected in the container 40, and only air purified while passing through the filter 46 is discharged through the discharge passage 48, passes through the fan motor 26 and is discharged to the outside through the outlet 28.

Figure 7:
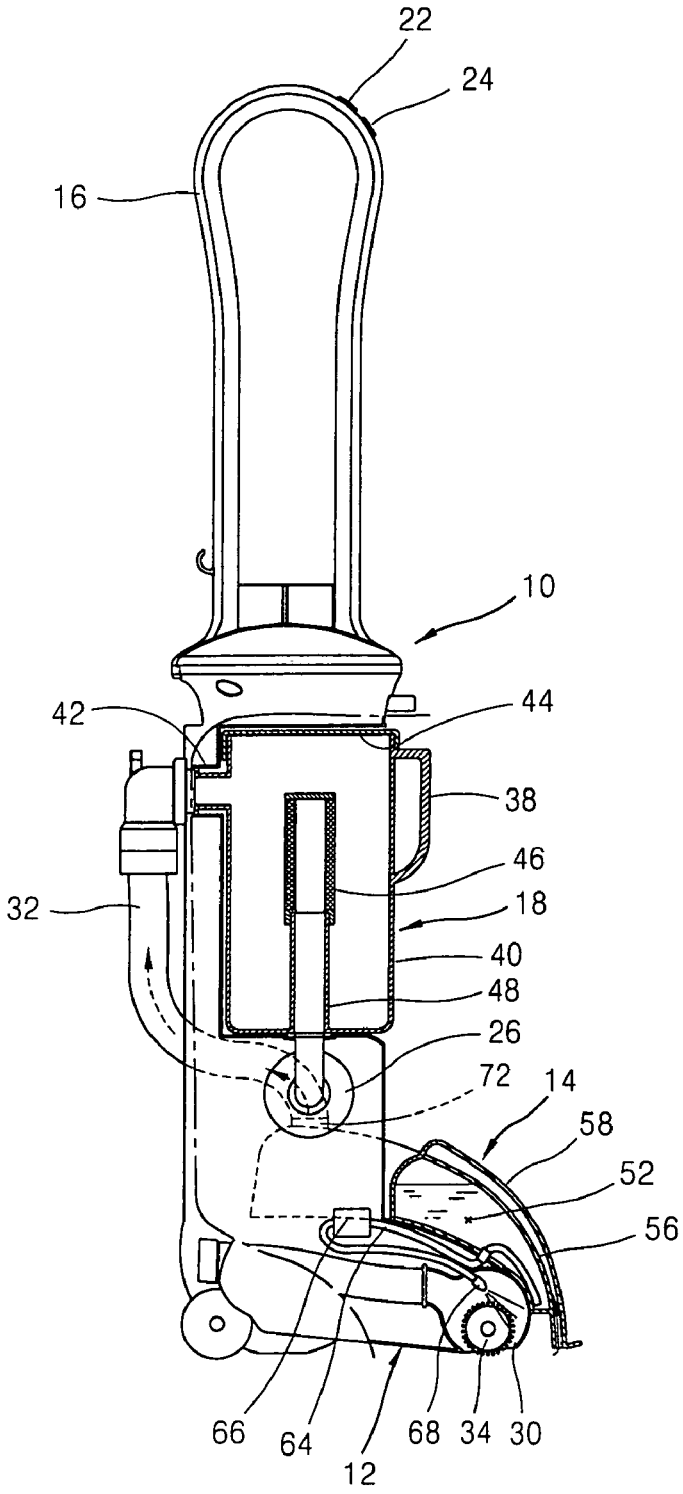

FIG. 7 is a view showing an operation when the complex type cleaner in accordance with the present invention is used in a water cleaning mode.

In addition, when the cleaner is used in the water cleaning mode, the user connects the suction hose 32 to the air discharge opening 72 formed at the water cleaning head 14. Then, the user operates the water cleaning switch 24 mounted to the body 10.

Then, the fan motor 26 is driven to generate a suction force, and at the same time the pump 64 is driven, thereby spraying cleaning water onto the floor or the carpet.

The cleaning water stored in the first chamber 54 is guided to the spray nozzle 68 through the cleaning water supply hose 64 by pumping force generated by driving the pump 64, and the cleaning water is sprayed onto the floor or the carpet from the spray nozzle 68.

And, the brush 34 mounted within the vacuum cleaning head 12 is rotated and rubs the region to be cleaned or the carpet onto which the cleaning water is sprayed, thereby performing a washing job, and water contaminated after completing the cleaning is sucked into the nozzle portion 80 of the suction nozzle 58 by the suction force generated by driving the fan motor 26.

The contaminated water having been sucked into the nozzle portion 80 of the suction nozzle 58 is guided by the guide passage portion 82 and flows into the second chamber 54 through the inlet 70. At this time, air inside the second chamber 54 is discharged through the air discharge opening 72 to the suction hose 34, and the air having been discharged through the suction hose 34 flows into the dust collecting container 18, passes through the fan motor 26 and then is discharged to the outside.

At this time, water is prevented from being discharged through the air discharge opening 72 by the floater 74 mounted within the second chamber 54. That is, when water flowing into the second chamber 54 is filled to a certain level by the blocking plate 78 and then the water flowing into the second chamber 54 exceeds a certain level, the water goes over the blocking plate 78 and flows into the air discharge opening 72. Then, the floater 74 floats up by a buoyancy force and so closes up the air discharge opening 72, thereby preventing water from being discharged through the air discharge opening 72.

Effects of the complex type cleaner in accordance with the present invention will be described as follows.

By installing a water cleaning head which performs water cleaning at a vacuum cleaning head, dust and foreign substances are sucked through the vacuum cleaning head at the time of a vacuum cleaning mode, and at the time of a water cleaning mode, cleaning water stored in the first chamber of the water cleaning head is supplied to the region to be cleaned through a cleaning water supply unit, and water contaminated after completing a cleaning job is sucked through a suction nozzle and is stored in the second chamber. Accordingly, one cleaner can selectively perform vacuum cleaning and water cleaning, thereby reducing the cost, enhancing the user's convenience and facilitating storage of the cleaner.

As a suction nozzle for sucking water contaminated after completing a cleaning job, a storage container for storing the contaminated water sucked through the suction nozzle, and a cleaning water spray unit for spraying cleaning water onto a region to be cleaned are integrally formed and installed at a suction head, the number of parts and a production cost can be reduced, and a small capacity fan motor can be employed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A composite cleaner, comprising:

a body having a dust collecting container that receives and stores dust;

a fan motor installed in the body so as to generate a suction force;

a dry cleaning head coupled to a lower end portion of the body, wherein dust is drawn into the cleaner by the suction force through the dry cleaning head in a dry cleaning mode; and a wet cleaning head mounted on the dry cleaning head, wherein the wet cleaning head is configured to spray cleaning fluid onto a region to be cleaned, to draw in contaminated fluid in a wet cleaning mode, and to store the contaminated fluid, wherein the wet cleaning head comprises:

a storage container mounted on an upper surface of the dry cleaning heads; and a suction nozzle provided at an upper surface of the storage container, wherein the suction nozzle is configured to draw in contaminated fluid in the wet cleaning mode, wherein the storage container is divided into a first chamber that receives and stores unused cleaning fluid in the wet cleaning mode, and a second chamber that receives and stores contaminated fluid in the wet cleaning mode.

2. The cleaner of claim 1, wherein the body includes a container mounting portion that receives the dust collecting container therein, a dry cleaning switch and a wet cleaning switch.

3. The cleaner of claim 1, wherein the dry cleaning head comprises a dust suction opening, provided at a lower surface thereof, and a hose connection portion provided at a rear portion of the dry cleaning head, wherein the hose connection portion is connected to a suction hose that guides dust drawn in through the dust suction opening into the dust collecting container.

4. The cleaner of claim 3, wherein the suction hose is connected to the dry cleaning head in the dry cleaning mode and is connected to the water cleaning head in the wet cleaning mode.

5. The cleaner of claim 1, wherein the dry cleaning head further comprises a brush rotatably installed in the dry cleaning head and configured to sweep up dust from a region to be cleaned in the dry cleaning mode, and to rub the region to be cleaned onto which cleaning fluid has been sprayed in the wet cleaning mode.

6. The cleaner of claim 1, further comprising a cleaning fluid supply device provided at the first chamber and configured to spray cleaning fluid stored in the first chamber onto the region to be cleaned.

7. The cleaner of claim 6, wherein the cleaning fluid supply device comprises:

a cleaning fluid supply hose connected to the first chamber and so as to supply cleaning fluid stored in the first chamber to the region to be cleaned;

a pump provided at the cleaning fluid supply hose so as to pump the cleaning fluid stored in the first chamber through the cleaning fluid supply hose; and a spray nozzle provided at an end of the cleaning fluid supply hose and configured to spray cleaning fluid pumped by the pump onto the region to be cleaned.

8. The cleaner of claim 1, wherein the second chamber includes an inlet in communication with the suction nozzle so as to guide contaminated fluid into the second chamber and a discharge opening that discharges air from the second chamber as contaminated fluid flows in through the inlet.

9. The cleaner of claim 8, wherein the discharge opening is connected to the fan motor and to a suction hose.

10. The cleaner of claim 8, further comprising a float provided on the second chamber wherein the float is lifted and closes the discharge opening in response to a buoyant force generated by contaminated fluid in the second chamber so as to prevent fluid flowing into the second chamber from being discharged through the discharge opening.

11. The cleaner of claim 8, further comprising a blocking plate provided in the second chamber, wherein the blocking plate prevents contaminated fluid in the second chamber from flowing into an area near the discharge opening until the contaminated fluid reaches a predetermined level.

12. The cleaner of claim 1, wherein the suction nozzle of the wet cleaning head comprises:

a nozzle portion; through which contaminated fluid is drawn into the wet cleaning head; and a guide passage portion integrally formed with the nozzle portion so as to guide the contaminated fluid drawn in through the nozzle portion to an inlet into the second chamber.

13. The cleaner of claim 12, wherein the nozzle portion is provided with an entrance portion configured to smoothly guide the contaminated fluid into the wet cleaning head.

14. The cleaner of claim 1, wherein in the dry cleaning mode, dust is deposited into the dust collecting container by the dry cleaning head, and in the wet cleaning mode, air drawn in by the suction nozzle together with contaminated fluid flows into the dust collecting container and is discharged therefrom.

15. The cleaner of claim, 1, wherein the fan motor is configured to draw air into the dust collecting container in both the dry and wet cleaning modes.

16. The cleaner of claim 1, further comprising a suction hose, one end of the suction hose being selectively connectable to the dry cleaning head in the dry cleaning mode, and to an air discharge opening of the wet cleaning head in the wet cleaning mode.

17. The cleaner of claim 1, wherein the suction nozzle is coupled to the wet cleaning head and extends across at least a portion of each of the first and second chambers.

18. The cleaner of claim 1, further comprising a brush rotatably installed within the dry cleaning head, wherein the first chamber and the second chamber are spaced along a direction of an axis of rotation of the brush.

19. The cleaner of claim 1, wherein the wet cleaning head is positioned beneath the dust collecting container.

20. The cleaner according to claim 1, further comprising a spray device provided in the wet cleaning head adjacent to the suction nozzle, wherein the spray device sprays cleaning fluid onto a region to be cleaned.

* * * * *